US005903070A

United States Patent [19]

Göbel

[11] Patent Number: 5,903,070

[45] Date of Patent: May 11, 1999

[54] ELECTROMAGNETIC ACTUATOR HAVING A SLENDER STRUCTURE

[75] Inventor: Thomas Göbel, Bocholtz, Netherlands

[73] Assignee: FEV Motorentechnik GmbH & Co. KG, Aachen, Germany

[21] Appl. No.: 08/969,943

[22] Filed: Nov. 25, 1997

[30] Foreign Application Priority Data

Nov. 29, 1996 [DE] Germany ..... 296 20 741 U

[51] Int. Cl.[6] ..... H02K 33/02; H02K 1/06

[52] U.S. Cl. ..... 310/17; 335/278; 335/281

[58] Field of Search ..... 310/12, 15, 17, 310/23, 24; 335/278, 281

[56] References Cited

U.S. PATENT DOCUMENTS 5,066,980 11/1991 Schweizer ..... 335/255

5,412,267 5/1995 Okada et al. ..... 310/42

*Primary Examiner*—Nestor Ramirez

*Assistant Examiner*—Judson H. Jones

*Attorney, Agent, or Firm*—Venable Gabor J. Kelemen

[57] ABSTRACT

The invention relates to an electromagnetic actuator including at least one electromagnet which has a yoke body (1) provided with a coil winding (6), and an armature (10) which is connected with a setting means and which, against the force of a resetting means (11), assumes a contacting relationship with a pole face (12) of the yoke body (1) when the coil winding (6) is energized. The yoke body (1) has an essentially rectangular outline and has at least two parallel side faces (4). The pole face (12) of the yoke body (1) is formed as a circular surface and the armature (10) is formed as a circular disk.

12 Claims, 3 Drawing Sheets

ELECTROMAGNETIC ACTUATOR HAVING A SLENDER STRUCTURE

DESCRIPTION

The invention relates to an electromagnetic actuator including at least one electromagnet having a yoke body provided with a coil winding, and an armature which is connected with a setting means and which moves into contact with a pole face of the yoke body against the force of a resetting means when the coil winding is being supplied with current.

When electromagnetic actuators are used, often the problem is encountered that the yoke body carrying the coil winding has relatively large dimensions to take into consideration the setting forces to be applied. Thus, for example, problems are encountered when such electromagnetic actuators are used for operating cylinder valves in reciprocating piston-type engines. Particularly in four-valve engines of up-to-date design only small accommodation widths are available, since the width of two adjoining actuators may be at the most as large as the smallest distance between two adjoining valves of a cylinder. This distance is significantly exceeded in the round actuators used heretofore.

It is therefore the object of the invention to provide an electromagnetic actuator which may be installed under narrow space conditions and may be used in particular to operate cylinder valves of reciprocating piston-type engines of four-valve design.

This object is achieved by the invention in that the yoke body has an essentially rectangular outline having at least two parallel side faces and that the pole face on the yoke body is configured as a circular face and the armature is configured as a circular disc. Since the armature as a movable component is not free from twisting torques about the axis of motion, for example, when helical compression springs are used as resetting means, the springs introduce torsion forces, the design of the armature as a circular disc permits a free and unimpeded rotary motion of the armature about the axis of motion, thus eliminating interfering effects. The parallel side faces expediently border the long sides of the yoke body and the distance of the long sides to one another defining the narrow sides corresponds at least to the diameter of the armature.

While in principle it is possible to configure the side faces of the narrow sides of the yoke body to be planar as well, it is expedient according to another feature of the invention to design the side faces of the narrow sides such that they are of curved, preferably cylindrical configuration. Such a shape is particularly advantageous when at the yoke body, in the region of its two narrow sides, a respective pole shoe is arranged which projects beyond the pole face. The pole shoes which project beyond the pole face and which surround the periphery of the armature when it approaches the energized electromagnet, supply sufficiently high capturing forces.

According to a further feature of the invention the pole shoes have a cross section which increases as viewed from their free end. In this manner, in case of a cylindrical shape of the narrow sides, the pole shoes function at their external side as a so-called control cone. By virtue of the configuration of the control cone it is possible to influence and optimize the course of the magnetic forces which affect the armature as it approaches the pole face.

According to a further advantageous feature of the invention the coil winding is disposed in a cylindrical recess of the yoke body. Since the coil winding lies exclusively inside the magnet core, there is obtained, as compared to actuators having magnet coils that are situated partially externally, a reduction of the ohmic resistance by about 20%.

The invention will be discussed in more detail with reference to schematic drawings of exemplary embodiments.

Figure 1:
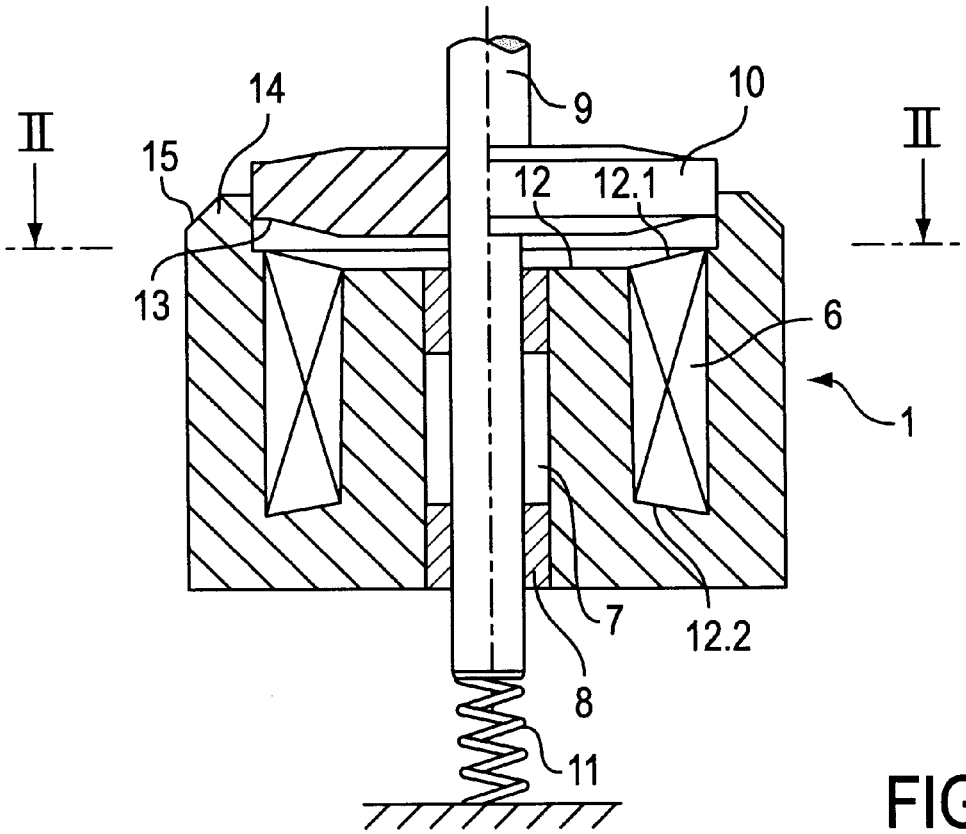
FIG. 1 shows a vertical section of an electromagnetic actuator.
Figure 2:
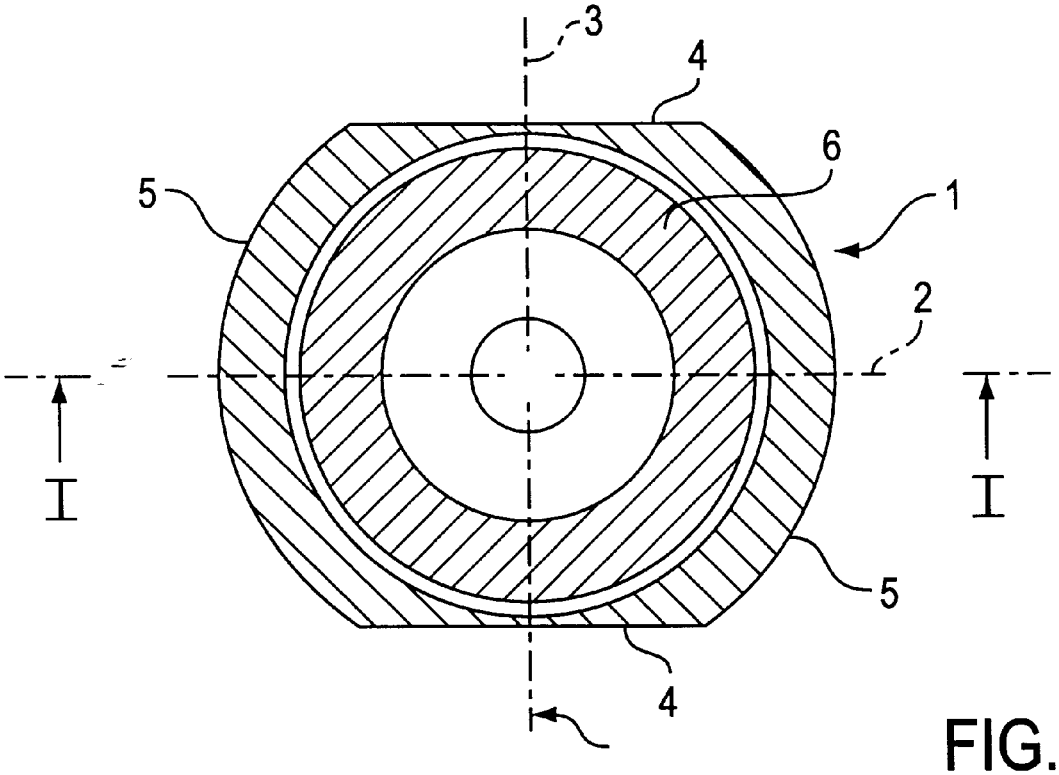
FIG. 2 shows a horizontal section taken along line II—II of FIG. 1.

The electromagnetic actuator illustrated in FIGS. 1 and 2 is formed essentially of a yoke body 1 having an essentially rectangular cross-sectional outline. The rectangular shape of the outline is defined in such a manner by the different lengths of the two transverse axes 2 and 3 that the two side faces 4 extending parallel to the transverse long axis 2 form the long sides of the rectangle, and the two other side faces 5 which are associated with the transverse short axis 3 constitute the narrow sides of the cross-sectionally rectangular form. What is decisive, however, is the arrangement that at least the two side faces 4 of the yoke body 1 forming the long sides extend parallel to one another.

The yoke body 1 has a cylindrical recess in which a fitting coil winding 6 is accommodated which may be supplied with current by a non-illustrated control device.

The yoke body 1 further has a central recess 7 in which a guide rod 9 is axially reciprocatingly guided by a bearing 8. On the guide rod 9 which is coupled with a setting means to be operated, an armature 10 is arranged which, according to the shape predetermined by the coil winding 6, is configured as a circular disc. With the guide rod 9 a resetting means 11, for example, a compression spring, is associated which is arranged in such a manner that when the coil winding 6 is energized, the armature 10 has to be moved against the force of the resetting means 11. If the coil winding 6 is de-energized, the armature 10 is again returned into its non-illustrated position of rest by the force of resetting spring 11.

In FIG. 1 the armature 10 is shown in a position in the approach phase during the energized state of the coil winding 6. The end face 12.1 of the coil winding 6 as well as the adjoining regions of the yoke body 1 form the pole face 12 of the electromagnet. In the embodiment shown, the face 13 of the armature 10 oriented towards the pole face 12 is, at least in the edge region, conically outwardly tapering, and the associated region of the pole face 12 is correspondingly conically flaring, so that upon energization of the electromagnet the armature 10 is held in close engagement with the pole face 12, but is at the same time supported on those regions of the yoke body 1 which laterally adjoin the end face 12.1 of the coil winding 6.

The other end face 12.2 of the coil winding 6 is shaped as the end face 12.1 and the yoke body 1 has underneath the hollow cylindrical recess a cross section which is also conical. Stated differently, as seen in FIG. 1, the cylindrical recess of the yoke body 1 has an annular conical bottom which is disposed face-to-face with the end face 12.2 of the coil winding 6 and which is arranged as a mirror image of the end face 12.1. In this manner in the armature 10 as well as in the yoke body 1 approximately uniform passage areas are given for the radially throughgoing magnetic flux.

In the illustrated embodiment both narrow sides 5 of the yoke body 1 are curved; they are preferably of cylindrical configuration and formed as pole shoes 14 which project beyond the pole face 12. By virtue of the arrangement of the pole shoes 14 an increase in the capturing force affecting the approaching armature 10 is obtained. FIG. 1 depicts the armature 10 already in a phase in which it approaches the pole face 12. Dependent upon the configuration of the control cone 15 at the pole shoes 14 it is possible to adapt the course of the magnetic force acting on the armature 10 to the course of the resetting spring 11.

Since in such an actuator construction the mutual distance of the long sides 4 defining the narrow sides 5 corresponds approximately to the diameter of the armature 10, it is feasible to adapt the geometry of the actuator to the available installation space by a suitable dimensioning of the armature diameter. The maximum permissible structural width predetermined by the distance of the two side faces 4 causes a pole face loss because of a corresponding reduction of the armature diameter. This is compensated for by the feasibility of arranging the elevated pole shoes 14 at the respective narrow sides. As a result, compared to conventional electromagnetic actuators, a magnetic force of approximately equal magnitude affects the armature in case the latter is at a distance from the pole face 12, but as the armature approaches the pole face, particularly immediately before impingement thereon, a significantly reduced peak force is present. In this manner the impingement velocity and thus the sound generation are reduced and a so-called rebound is practically avoided.

The pole shoes 14 may have a cross section which increases as viewed from their free end. In the present embodiment this is achieved by providing the pole shoes with a chamfer 15 at the outside in the region of their free end. The arrangement of such a "control cone" provides the possibility to influence the magnetic force acting on the armature during motions thereof as will be explained below in greater detail in conjunction with the force curves shown in FIG. 4.

Figure 3:
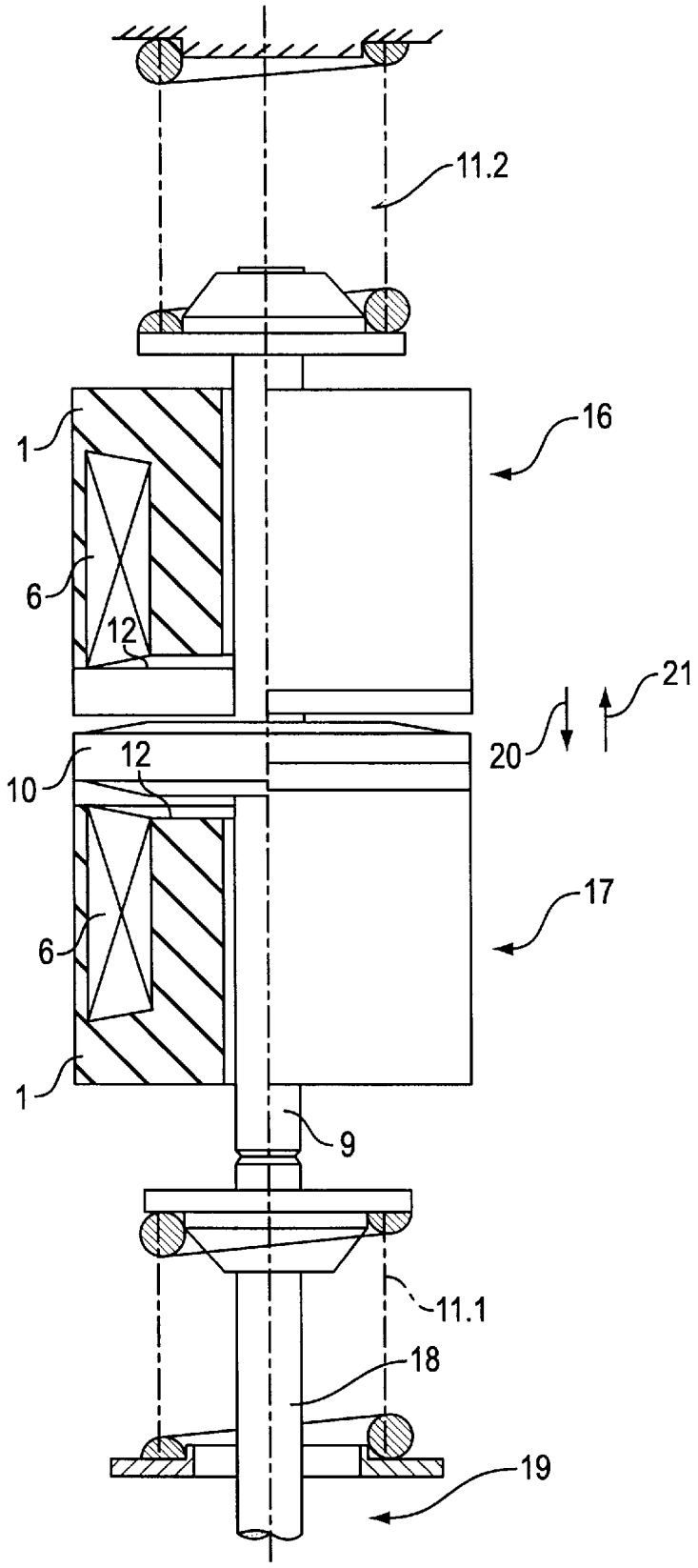
FIG. 3 shows an arrangement, partially in section, for actuating a cylinder valve in a reciprocating piston-type engine.

FIG. 3 illustrates an electromagnetic actuator for operating a cylinder valve of a reciprocating piston-type engine. The electromagnetic actuator is essentially formed of two electromagnets 16 and 17, each having a structure described in connection with FIGS. 1 and 2, so that identical components are provided with the same reference characters and, accordingly, reference may be made to the description pertaining to FIGS. 1 and 2.

The two electromagnets 16 and 17 are mutually spaced, and their pole faces are oriented towards one another. Between the two electromagnets the armature 10 is guided for reciprocation by the guide rod 9. The guide rod 9 is connected with the stem 18 of a cylinder valve 19 not shown in detail which, upon a displacement of the armature 10 is opened in the direction of the arrow 20 and is maintained in the open position for the duration of current supply of the coil winding 6 of the electromagnet 17 which functions as the opening magnet. When the coil winding 6 of the electromagnet 16 is supplied with current, the armature 10 is moved in the direction of the arrow 21, and the valve 19 is closed and is maintained in the closed position for the duration of current supply of the coil 6 of the electromagnet 16 which functions as the closing magnet. The resetting spring 11.1 serves as a closing spring for the cylinder valve 19 and constitutes, at the same time, the resetting means for the opening magnet 17. With the closing magnet 16 the spring 11.2 is associated which operates in the opening direction and which serves as resetting means for the closing magnet 16. In case the actuator is in a de-energized state, the armature 10 is held by the two springs 11.1 and 11.2 in a position of rest between the two magnets 16 and 17. In case of an actuation by means of an alternating current supply to the two electromagnets 16 and 17, the armature 10 may be moved back and forth between the two electromagnets, so that the cylinder valve periodically opens and closes. In this arrangement the actuation may affect the opening and the closing moments as well as the duration of the open and closed states of the cylinder valve.

During such a motion the armature 10 in each instance passes through the position of rest between the two pole faces, so that as the armature approaches the pole face, the force of the counteracting return spring has to be overcome in each instance by the magnetic force.

Figure 4:
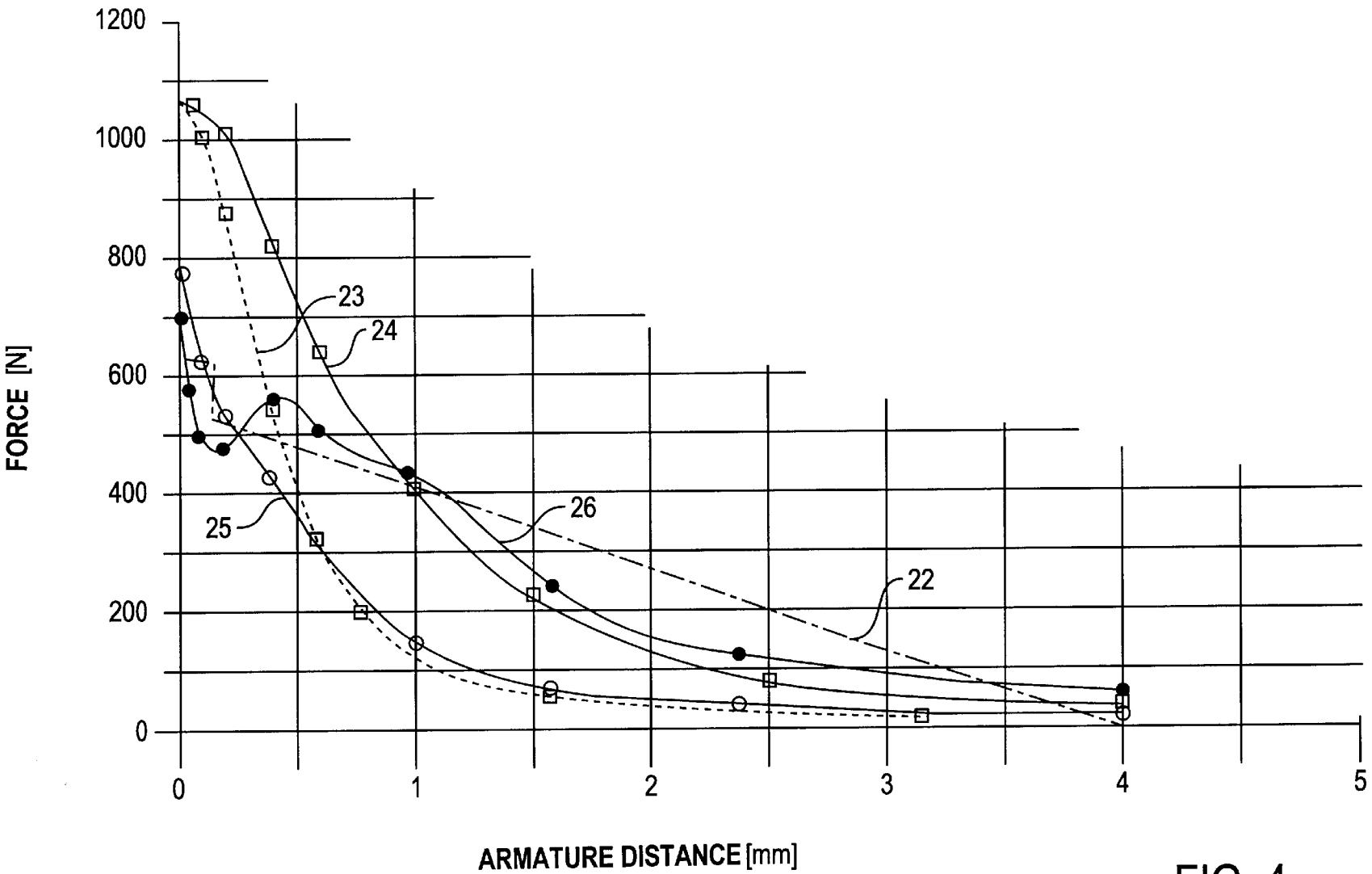
FIG. 4 shows the course of the magnetic forces affecting the armature in a conventional actuator and in an actuator according to the invention.

FIG. 4 shows the different curves of the magnetic force acting on the armature 10 as a function of the distance of the armature from a pole face of an energized electromagnet, starting as the armature passes through the position of rest. The curve 22 shows the course of the spring force of the associated resetting spring.

Curves 23 and 24 show the course of the magnetic force affecting the armature 10 in case of an electromagnet of conventional design; the curve 23 illustrates the course of the force in case of an energization with a 2 A current, whereas the curve 24 illustrates the course of the force in case of an energization with a 4 A current. The "negative force balance" between the course of the spring force 22 and the course of the magnetic forces 23 and 24 in the distance region between 0.5 and 4 is equalized by the kinetic energy which the armature possesses as it passes through the position of rest after leaving the previously de-energized other magnet.

The curves 25 and 26 show the course of the magnetic force for an electromagnet structured according to the invention as the armature 10 approaches. The curve 25 again shows the course of the force in case of energization with a current of 2 A, while the curve 26 shows the course of the force in case of an energization with a current of 4 A. Upon comparing the curve 23 with the curve 25, that is, in case of identical energization, it is seen that in the distance region between 4 and 0.5 approximately the same courses of force are present. This shows that despite the pole face of the electromagnet structured according to the invention and reduced as compared to conventional electromagnets, by virtue of the arrangement of the pole shoes an approximately identical course of force may be obtained. A very substantial difference, however, is obtained in the approach zone from 0.5 until impingement on the pole face. It is seen that by virtue of the arrangement of the pole shoes in conjunction with the so-called control cone, there occurs a significant reduction of the maximum magnet force and thus also a corresponding reduction of the impingement velocity of the armature on the pole face as compared to a conventional system. It is further seen that the magnet force affecting the armature upon impingement is only slightly in excess of the maximum resetting force of the spring, so that the impingement velocity is reduced, yet the magnet force has such a magnitude that the armature is securely held by the electromagnet against the force of the resetting spring.

The curve 26 shows the system according to the invention in case of an energization with a current of 4 A; the effect the control cone has on the course of the force becomes very clear. While in the distance zone between 4 and 1 the course of the curve 24 for the conventional system and the course of the curve 26 for the system according to the invention are still approximately the same, in the distance zone between 1 and 0 a significant drop of the magnet force occurs as a result of the effect of the pole shoes and the control cone, so that the magnet force extends almost parallel above the curve 22 of the spring force.

I claim:

1. An electromagnetic actuator comprising (a) a yoke body having (1) an essentially rectangular cross-sectional outline having a long axis and a short axis perpendicular to said long axis;

(2) two opposite first side faces and two opposite second side faces; said first side faces being parallel to one another; and (3) a pole face having a circular surface;

(b) an energizable and de-energizable coil winding carried by the yoke body;

(c) an armature formed as a circular disk; said armature being connectable to a setting means for being actuated by said armature; said armature being forced into a contacting relationship with said pole face by electromagnetic forces generated in an energized state of said electromagnet; and (d) resetting means operatively connected to said armature for opposing the electromagnetic forces.

2. The electromagnetic actuator as defined in claim 1, wherein said first side faces are parallel to said long axis.

3. The electromagnetic actuator as defined in claim 2, wherein said armature has a diameter; further wherein a distance between said first side faces corresponds at least to the length of said diameter.

4. The electromagnetic actuator as defined in claim 2, wherein said second side faces are curved.

5. The electromagnetic actuator as defined in claim 4, wherein said second side faces are cylindrical.

6. The electromagnetic actuator as defined in claim 1, wherein said yoke body further comprises pole shoes at respective said second side faces; said pole shoes projecting beyond said pole face.

7. The electromagnetic actuator as defined in claim 6, wherein said pole shoes have a free outer end, and an increasing cross-sectional area as viewed progressively away from said free outer end.

8. The electromagnetic actuator as defined in claim 1, wherein said coil winding has an end face forming at least one part of said pole face.

9. The electromagnetic actuator as defined in claim 1, wherein said yoke body has a cylindrical recess accommodating said coil winding.

10. The electromagnetic actuator as defined in claim 9, wherein said armature has an armature face oriented toward said pole face; said armature face has a conical edge region tapering in a radially outward direction; said pole face having a conical edge region facing said conical edge region of said armature face; said conical edge region of said pole face being generally parallel to said conical edge region of said armature face.

11. The electromagnetic actuator as defined in claim 10, wherein said cylindrical recess of said yoke body has a conical annular bottom arranged as a mirror image of said armature face.

12. The electromagnetic actuator as defined in claim 10, wherein said coil winding has an end face disposed in said conical edge region of said pole face.

* * * * *